US006901842B2

(12) United States Patent
Piras

(10) Patent No.: US 6,901,842 B2
(45) Date of Patent: Jun. 7, 2005

(54) PERCUSSION HYDRAULIC APPARATUS

(75) Inventor: Bernard Piras, Charly (FR)

(73) Assignee: Montabert S.A., Saint Priest (FR)

( * ) Notice: Subject to any disclaimer, the term of this patent is extended or adjusted under 35 U.S.C. 154(b) by 3 days.

(21) Appl. No.: 10/297,326

(22) PCT Filed: Jul. 10, 2001

(86) PCT No.: PCT/FR01/02228

§ 371 (c)(1),
(2), (4) Date: Jan. 13, 2003

(87) PCT Pub. No.: WO02/06014

PCT Pub. Date: Jan. 24, 2002

(65) Prior Publication Data

US 2004/0050243 A1 Mar. 18, 2004

(30) Foreign Application Priority Data

Jul. 13, 2000 (FR) ..... 00 09259

(51) Int. Cl.[7] ..... F01L 25/02

(52) U.S. Cl. ..... 91/286; 91/290; 91/303; 91/327

(58) Field of Search ..... 91/281, 286, 290, 91/303, 309, 327, 350

(56) References Cited

U.S. PATENT DOCUMENTS

| | | | | | |
|---|---|---|---|---|---|
| 4,022,108 | A | * | 5/1977 | Juvonen | 91/276 |
| 4,230,019 | A | * | 10/1980 | Castejon Castan | 91/220 |
| 4,635,531 | A | * | 1/1987 | Rode | 91/303 |
| 5,392,865 | A | * | 2/1995 | Piras | 173/17 |
| 5,669,281 | A | * | 9/1997 | Comarmond | 91/245 |

FOREIGN PATENT DOCUMENTS

| | | |
|---|---|---|
| FR | 2 045 289 A | 2/1971 |
| FR | 2 369 908 A | 6/1978 |

* cited by examiner

*Primary Examiner*—Hoang Nguyen
(74) *Attorney, Agent, or Firm*—Oliff & Berridge, PLC

(57) ABSTRACT

The invention concerns an apparatus comprising a body (1) containing a cylinder wherein is mounted sliding an impact piston (1) of a tool, the motion of the piston being controlled by a distributor (15) which, arranged coaxial to the impact piston, is mounted inside a distribution box (3). The distribution box (3) comprises a part axially overlapping the piston (1) and arranged concentric thereto, and the distribution box (3) defines with the piston a control chamber (13) which, successively put under the high (9) and the low (12) pressure of the fluid, communicates through a passage (16) arranged in the distribution box (3) with a chamber controlling (14) the movement of the distributor (15), to generate alternately low pressure and high pressure.

10 Claims, 5 Drawing Sheets

PERCUSSION HYDRAULIC APPARATUS

The subject of the present invention is a percussive hydraulic apparatus.

A percussive apparatus comprises a body containing a cylinder inside which is slideably mounted an impact piston for striking a tool, driven hydraulically back and forth by an incompressible fluid. The movement of the piston is commanded by a distributor which opens and closes hydraulic circuits placing certain chambers situated on each side of the piston successively in communication with a high-pressure circuit and with a low-pressure circuit to create this sequenced back and forth movement.

Document U.S. Pat. No. 4,230,019 relates to a percussive apparatus comprising several bodies, namely a main body including the impact piston, a body containing the distribution system and a body containing an energy accumulator. The layout of these various bodies is such that the power circuits which pass the fluid flow rates needed for activating the striking movement and the physically smaller command circuits which move the distributor, are formed both in the body containing the cylinder and in the body containing the distributor.

This gives rise to a certain number of disadvantages.

In particular, the command ducts are formed both in the body containing the cylinder and in the body containing the distributor and this entails achieving a seal between these two bodies.

The distribution body is positioned laterally which means that it has to be held firmly because of the accelerations it experiences as a result of the shock waves.

It is also known for a distribution block to be positioned above the body containing the cylinder, and this entails boring long holes in the body containing the cylinder so as to connect the various circuits, and this results in an increase in the cost of production and in an increase in the in-line pressure drops.

The object of the invention is to provide a percussive hydraulic apparatus in which the system for commanding the distributor is produced in a simple way and with a small bulk.

To this end, the percussive hydraulic apparatus to which it relates comprising a body containing a cylinder in which there is slideably mounted an impact piston for striking a tool, driven hydraulically back and forth by an incompressible fluid, the movement of the piston being controlled by a distributor which, arranged coaxially with respect to the impact piston, is mounted inside a distribution box, is characterized in that:

- the distribution box comprises a part interfering axially with the piston and arranged concentrically with respect to the latter, and
- the distribution box delimits with the piston a control chamber which, subjected in succession to the high and to the low pressure of the fluid, is in communication via a duct formed in the distribution box with a chamber commanding the movement of the distributor to create therein alternately a low pressure and a high pressure and therefore a sequence reversal of the resultant of the forces applied to the distributor.

Advantageously, the ducts connecting the control chamber to the high-pressure and low-pressure circuits, are formed in the distribution box.

This percussive hydraulic apparatus is of a compact structure because there is an overlap of the distribution box and of the cylinder containing the piston. Furthermore, the structure of this apparatus is simplified in that the circuits for commanding and controlling the distribution assembly are independent of the body of the cylinder and are formed in the distribution box. Thus, only the power circuits needed for moving the impact piston are machined in the body of the cylinder. It may be noted that one and the same distribution system can equip various types of percussive apparatus.

According to a first embodiment of this apparatus, the upper end of the piston has a central and axial bore in which there is engaged a central and axial cylindrical bearing surface belonging to the distribution box, the bore of the piston comprising an annular recess which with the cylindrical bearing surface of the distribution box delimits the control chamber.

According to a second embodiment of this apparatus, the upper end of the piston has a central and axial cylindrical bearing surface which is engaged in a central and axial bore formed in the distribution box, the cylindrical bearing surface of the piston having an annular groove which with the central bore of the distribution box delimits the control chamber.

In both embodiments, the apparatus comprises a lower chamber formed between the lower end of the distribution box and the piston, connected constantly to the low-pressure network by a duct, and a duct which, opening radially into the bore in which the piston slides with respect to the distribution box, above the duct placing the control chamber and the command chamber of the distributor in communication, is constantly connected to the high-pressure network, the movement of the piston with respect to the distribution box successively placing the control chamber in communication with the lower chamber connected to the high-pressure network and the duct connected to the low-pressure network. The duct supplying the lower chamber, just like the duct connected to the low-pressure network, are formed in the distribution box.

In any event, the invention will be clearly understood with the aid of the description which follows, with reference to the appended schematic drawing which, by way of nonlimiting examples, depicts two forms of embodiment of this apparatus:

Figure 1:
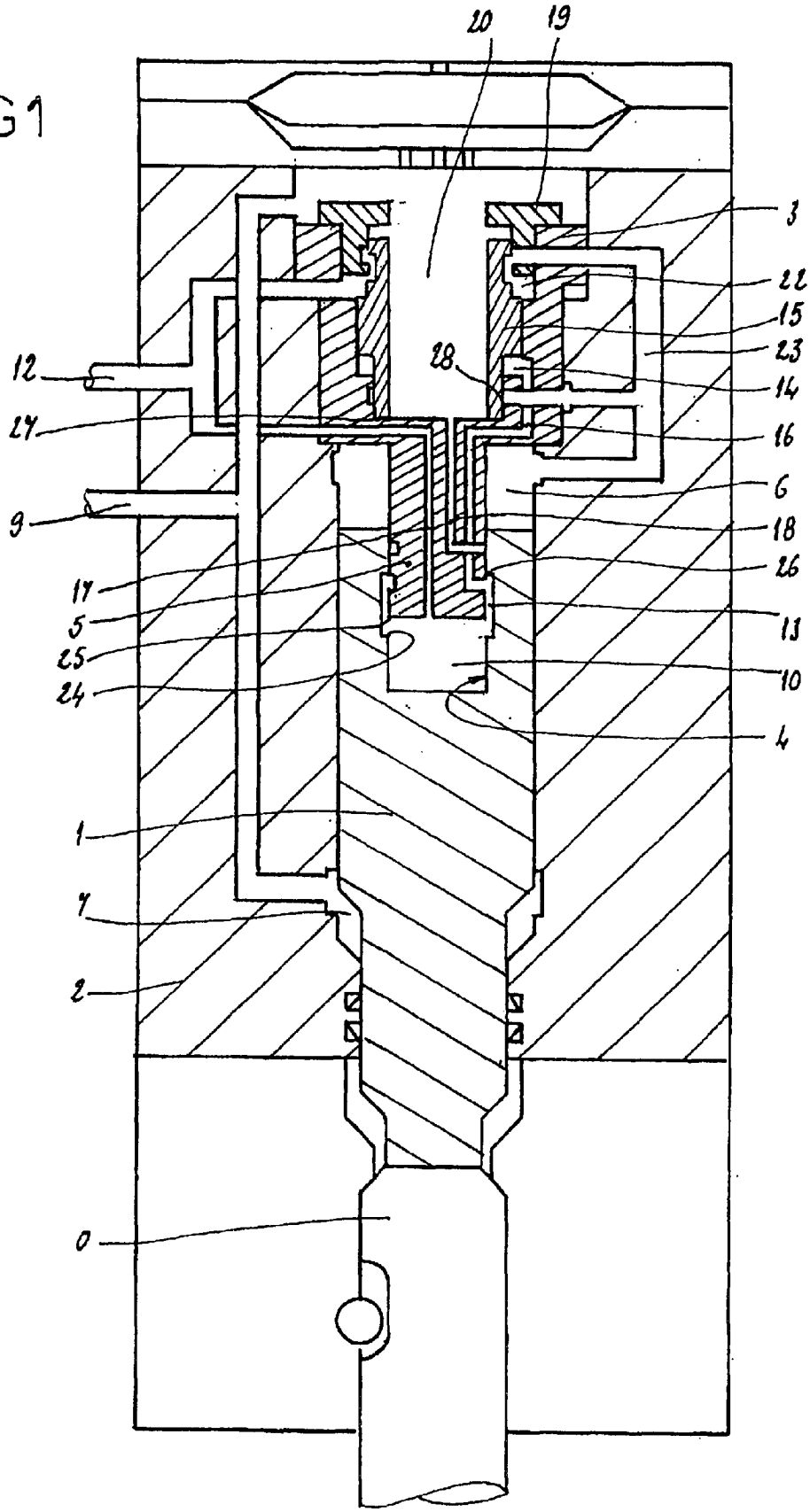
FIGS. 1 to 4 are four views in longitudinal section of this apparatus during four phases of operation.

The apparatus depicted in FIGS. 1 to 4 comprises a piston 1 mounted to slide inside a cylinder formed in a body 2. During its back and forth movement, the piston is intended to strike against the upper end of a tool 0. The body 2 contains, above the piston 1, a distribution box 3. The piston 1 comprises a central and axial bore 4 inside which is engaged a cylindrical bearing surface 5 belonging to the distribution box 3. The piston with its cylinder and with the distribution box 3 delimits at least three chambers:

- an annular driving chamber 6 situated above the piston,
- an antagonist annular chamber 7 the cross-sectional area of which is small and which is always in communication with the high-pressure supply circuit 9, and
- a central or lower chamber 10 constantly connected to the low-pressure circuit 12.

For a constant rate of flow of pressurized fluid, the frequency of the apparatus can be chosen according to the choice of the areas of the various cross sections. This choice determines, for an impact piston stroke, the capacity of the apparatus and therefore its striking frequency for a given supply flow rate.

The back and forth movement of the piston is obtained by communication between the driving chamber 6 and, alternately, the high-pressure network 9 and the low-pressure network 12 so that the resultant of the hydraulic forces applied to the piston 1 is exerted in one direction and then the other in succession.

The bore of the piston comprises an annular groove or recess which with the cylindrical bearing surface of the distribution box delimits an annular control chamber 13. According to the position of the piston with respect to the cylindrical bearing surface 5 of the distribution box it is possible to establish communication between a chamber 14 for commanding the movement of the distributor 15 via a duct 16 and the control chamber 13, and either the high-pressure network 9 or the low-pressure network 12.

To this end, the cylindrical bearing surface of the distribution box 3 comprises a duct 17 for placing the lower chamber 10 in communication with the low-pressure network 12, and a duct 18 opening radially into the bore 4, above the control chamber 13, and connected to the high-pressure network 9.

The distributor 15 delimits three chambers with the distribution box 12 and the cover 19:

- a central chamber 20 in constant communication with the high-pressure supply network 9,
- an annular chamber 22 always in communication with the low-pressure circuit 12, and
- the annular chamber 14, antagonist to the chamber 22 and connected via the duct 16 to the control chamber 13.

For the remainder of the description it is taken, by way of example, that the distributor 15 is given a downward movement when the command chamber 14 is connected to the low-pressure circuit 12, and an upward movement when this chamber communicates with the high-pressure circuit 9.

The back and forth movement of the distributor 15 is achieved by communication between the command chamber 14 and, alternately, the high-pressure circuit 9 and the low-pressure circuit 12 so that, depending on the areas chosen for the cross sections of the three chambers 14, 19, 22, the resultant force applied to the distributor is exerted in one direction and then the other in succession.

The initial state is the one depicted in FIG. 1 in which the distributor 15 is in the low position and the piston 1 is in the low position. As soon as the pressurized fluid flows into the high-pressure duct 9, the resultant of the forces applied to the distributor keeps the latter in the low position, the command chamber 14 being connected to the low-pressure circuit via the duct 16, the control chamber 13, the lower chamber 10 and the duct 17. The resultant of the forces applied to the impact piston causes the latter to rise, because the driving chamber 6 is connected to the low-pressure circuit via a duct 23 and the annular groove 22.

Figure 2:
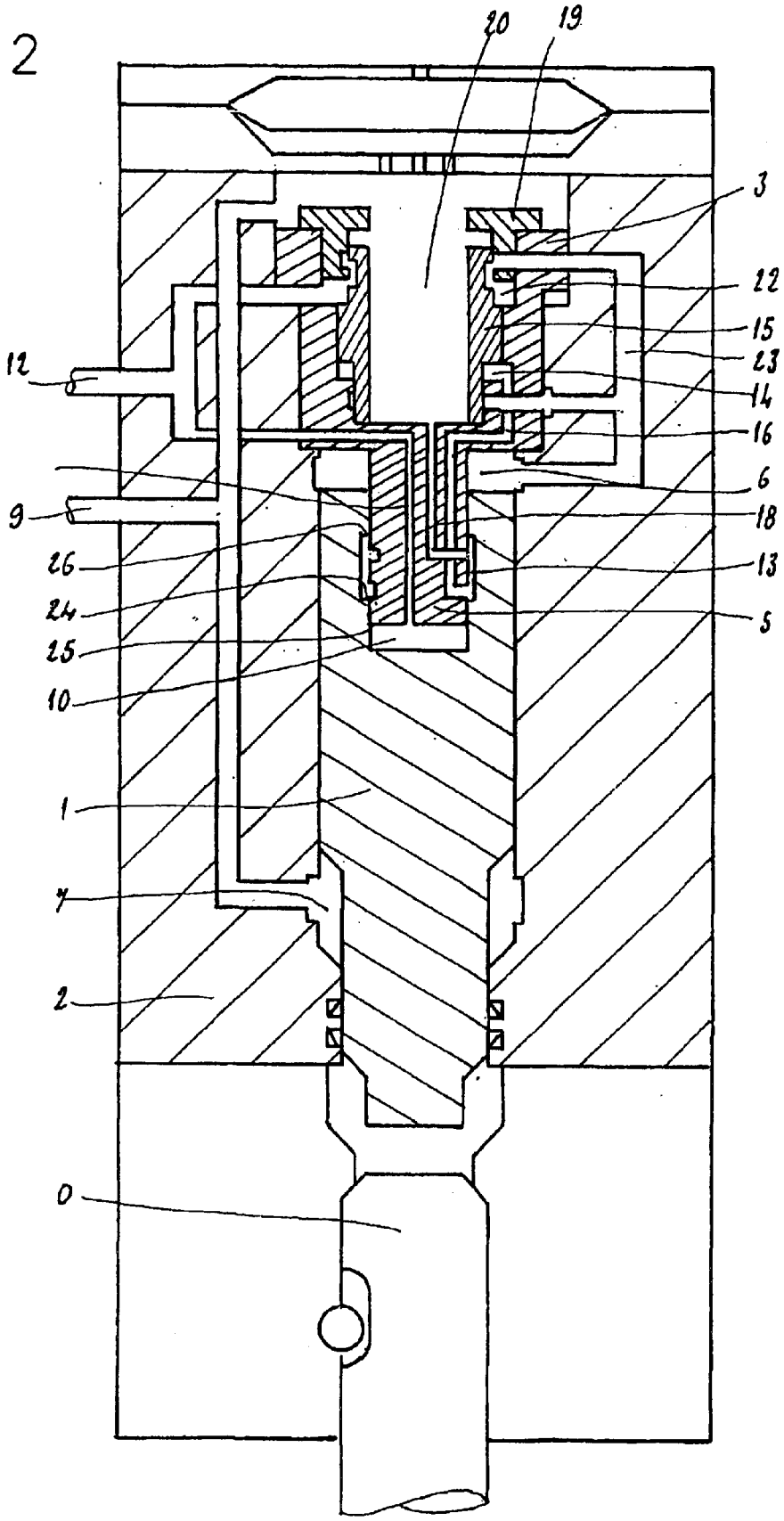
Figure 3:
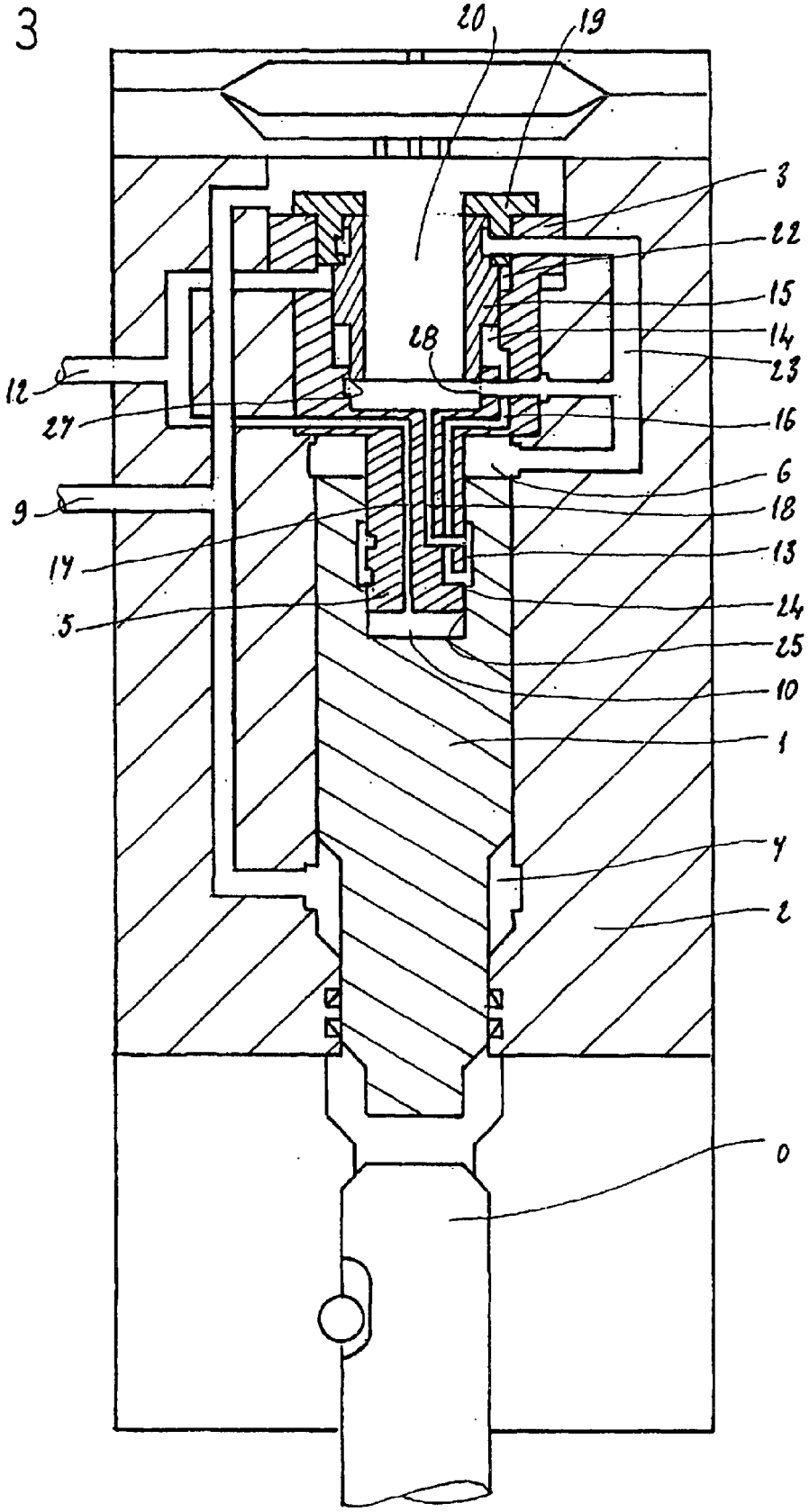
Figure 4:
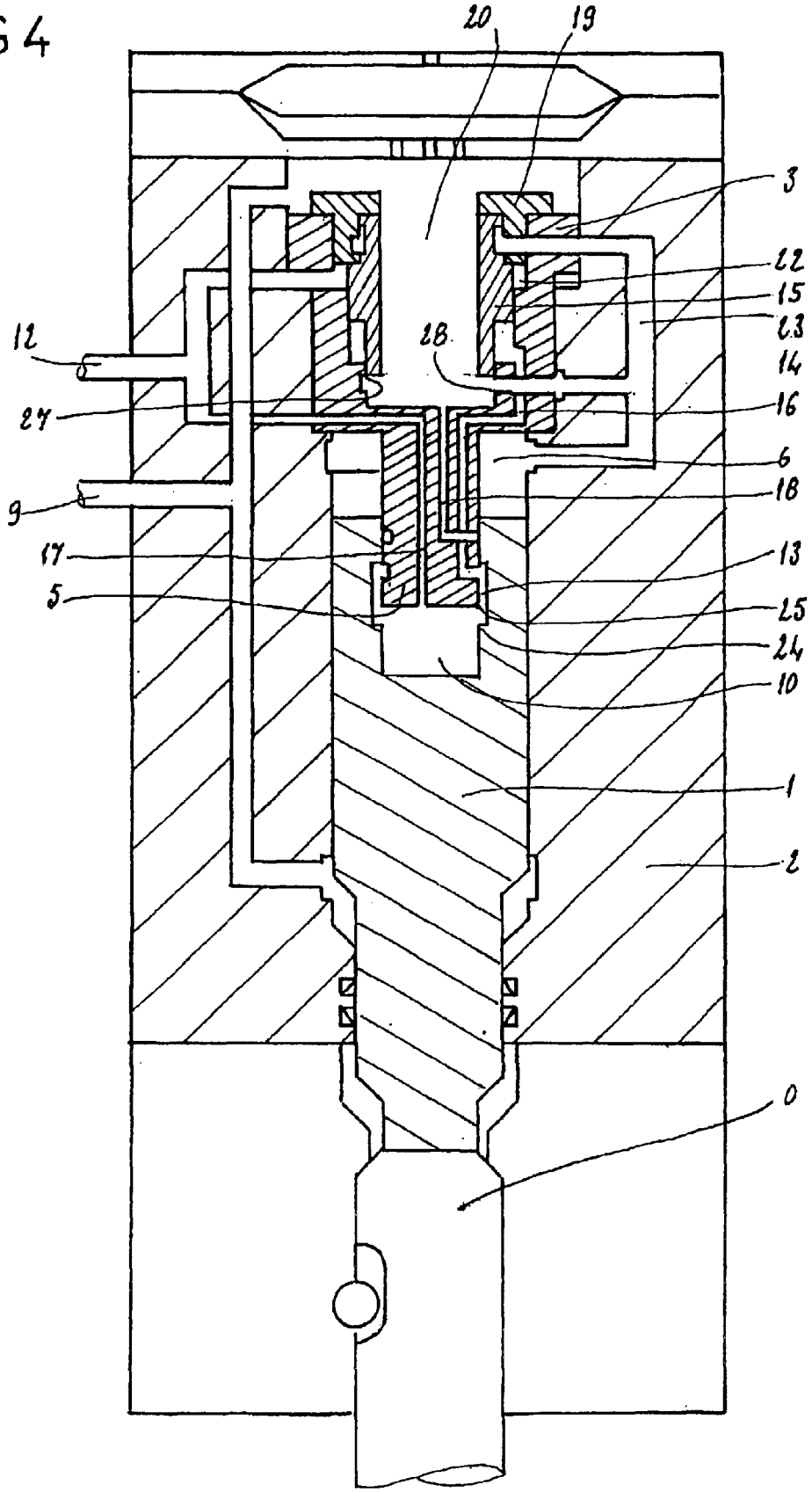

During the upward movement of the impact piston, the following operations take place:

- the edge 24 of the annular recess forming the control chamber 13 passes the edge 25 of the cylindrical bearing surface of the distribution box 3, thus isolating the command duct 16 from the low-pressure circuit.
- At the end of the upward movement of the impact piston 1, as shown in FIG. 2, the edge 26 of the piston uncovers the opening of the duct 18 connected to the high pressure, thus establishing communication between the high-pressure circuit and the command duct 16 and the command chamber 14 via the control chamber 13.
- The command chamber 14 of the distributor 15 is then at the high pressure, which means that the resultant of the forces applied to the distributor causes the latter to rise, as shown in FIG. 3.
- The edge 27 of the distributor 13 uncovers the edge 28 of the distribution box 3 and establishes communication between the high-pressure fluid from the circuit 9 and from the central chamber 20, and the duct 23 and the driving chamber 6.
- As the distributor 15 completes it upward stroke, the resultant of the forces applied to the piston 1 accelerates the latter downward for its impact stroke, as shown in FIG. 4.
- The command circuit 14, 16 of the distributor is isolated from the high pressure and placed in communication with the low-pressure circuit via the control chamber 13 and the lower chamber 10. The resultant of the forces applied to the distributor is then directed downward and the distributor begins its downward movement. At the same time, the impact piston 1 reaches its impact zone.
- The edge 27 of the distributor 15 passes the edge 28 of the distribution box 3, thus isolating the driving chamber 6 from the impact piston.
- The distributor establishes communication between the low-pressure circuit 12 and the driving chamber 6. The impact piston and the distributor are then in the low position depicted in FIG. 1 and the working cycle can recommence.

Figure 5:
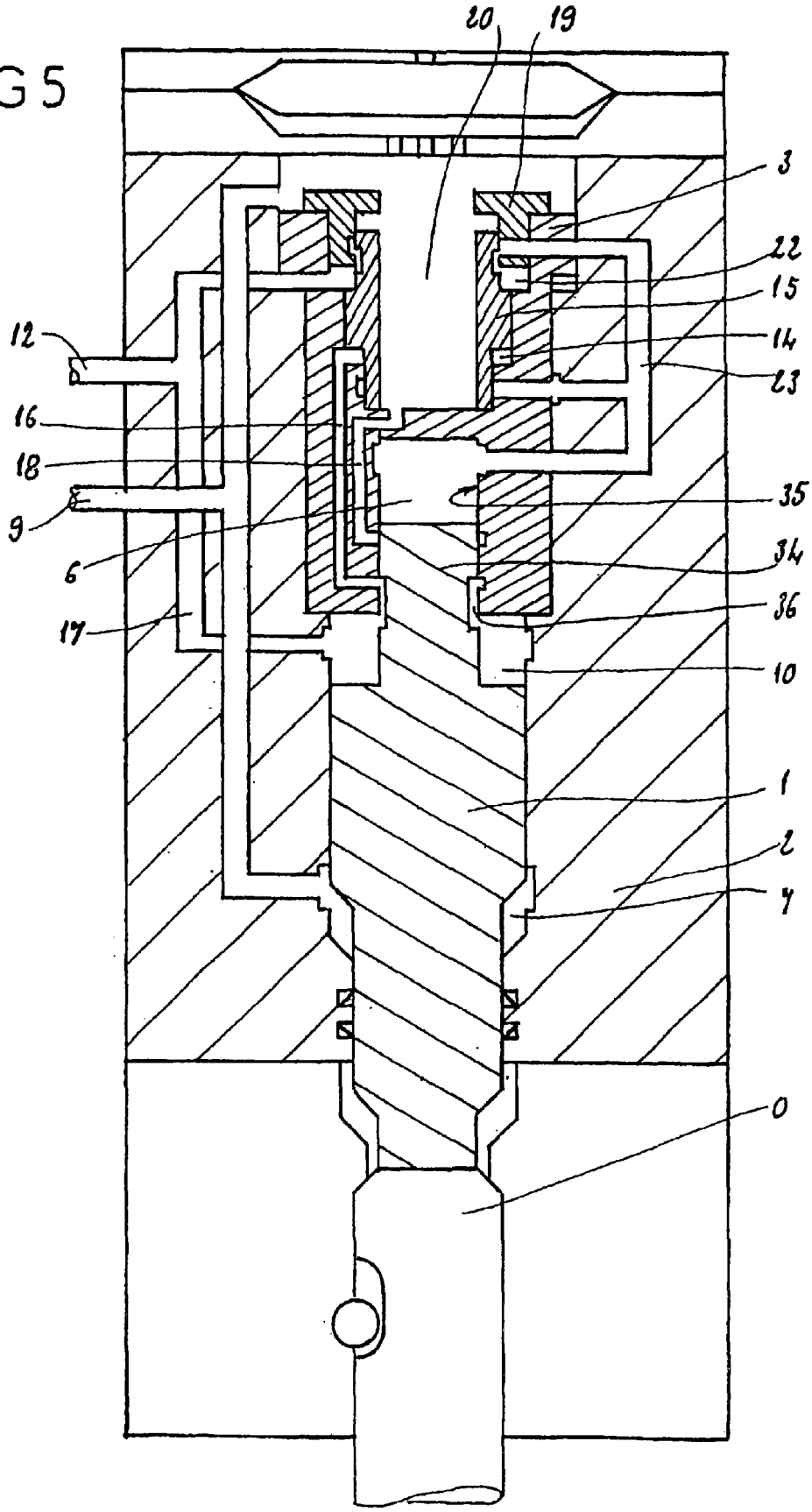
FIG. 5 is a view in longitudinal section of a second embodiment.

FIG. 5 depicts an alternative form of embodiment of this apparatus, in which the same elements are denoted by the same references as before. In this case, the overlapping of the distribution box 3 and of the impact piston 1 is the result of the fact that the impact piston has a central cylindrical bearing surface 34 which is engaged in a central bore 35 formed in the distribution box 3. The cylindrical bearing surface 34 has an annular groove delimiting the control chamber 36. The lower chamber 10 is then no longer a central chamber but an annular chamber.

As goes without saying, the invention is not restricted simply to the forms of embodiment of this percussive apparatus which have been described hereinabove by way of examples; on the contrary, it encompasses all alternative forms thereof.

What is claimed is:

1. A percussive hydraulic apparatus comprising a body (2) containing a cylinder in which theta is slideably mounted an impact piston (1) for striking a tool, driven hydraulically back and forth by an incompressible fluid, the movement of the piston being controlled by a distributor (15) which, arranged coaxially with respect to the impact piston, is mounted inside a distribution box (3), characterized in that:

- the distribution box (3) comprises a part interfering axially with the piston (1) and arranged concentrically with respect to the latter, and
- the distribution box (3) delimits with the piston a control chamber (13) which, subjected in succession to the high (9) and to the low (12) pressure of the fluid, is in communication via a duct (16) formed in the distribution box (3) with a chamber (14) commanding the movement of the distributor (15) to create therein alternately a low pressure and a high pressure and therefore a sequence reversal of the resultant of the forces applied to the distributor (15).

2. The percussive hydraulic apparatus as claimed in claim 1, characterized in that the ducts (17, 18) connecting the control chamber (13) to the high-pressure and low-pressure circuits, are formed in the distribution box (3).

3. The percussive hydraulic apparatus as claimed in claim 1, characterized in that the upper end of the piston (1) has a central and axial bore (4) in which there is engaged a central and axial cylindrical bearing surface (5) belonging to the distribution box (3), the bore (4) of the piston comprising an annular recess (13) which with the cylindrical bearing surface (5) of the distribution box (3) delimits the control chamber.

4. The percussive hydraulic apparatus as claimed in claim 1, characterized in that the upper end of the piston (1) has a central and axial cylindrical bearing surface (34) which is engaged in a central and axial bore (35) formed in the distribution box (3), the cylindrical bearing surface (35) of the piston (1) having an annular groove (36) which with the central bore (35) of the distribution box (3) delimits the control chamber.

5. The percussive hydraulic apparatus as claimed in claim 1, characterized in that it comprises a lower chamber (10) formed between the lower end of the distribution box (3) and the piston (1), connected constantly to the low-pressure network by a duct (17), and a duct (18) which, opening radially into the bore (4) in which the piston (1) slides with respect to the distribution box (3), above the duct (16) placing the control chamber (10) and the command chamber (14) of the distributor in communication, is constantly connected to the high-pressure network, the movement of the piston (1) with respect to the distribution box (3) successively placing the control chamber (10) in communication with the lower chamber (10) connected to the high-pressure network and the duct (18) connected to the low-pressure network.

6. The percussive hydraulic apparatus as claimed in claim 2, characterized in that the upper end of the piston (1) has a central and axial bore (4) in which there is engaged a central and axial cylindrical bearing surface (5) belonging to the distribution box (3), the bore (4) of the piston comprising an annular recess (13) which with the cylindrical bearing surface (5) of the distribution box (3) delimits the control chamber.

7. The percussive hydraulic apparatus as claimed in claim 2, characterized in that the upper end of the piston (1) has a central and axial cylindrical bearing surface (34) which is engaged in a central and axial bore (35) fanned in the distribution box (3), the cylindrical bearing surface (35) of the piston (1) having an annular groove (36) which with the central bore (35) of the distribution box (3) delimits the control chamber.

8. The percussive hydraulic apparatus as claimed in claim 2, characterized in that it comprises a lower chamber (10) formed between the lower end of the distribution box (3) and the piston (1), connected constantly to the low-pressure, network by a duct (17), and a duct (18) which, opening radially into the bore (4) in which the piston (1) slides with respect to the distribution box (3), above the duct (16) placing the control chamber (10) and the command chamber (14) of the distributor in communication, is constantly connected to the high-pressure network, the movement of the piston (1) with respect to the distribution box (3) successively placing the control chamber (10) in communication with the lower chamber (10) connected to the high-pressure network and the duct (18) connected to the low-pressure network.

9. The percussive hydraulic apparatus as claimed in claim 3, characterized in that it comprises a lower chamber (10) formed between the lower end of the distribution box (3) and the piston (1), connected constantly to the low-pressure network by a duct (17), and a duct (18) which, opening radially into the bore (4) in which the piston (1) slides with respect to the distribution box (3), above the duct (16) placing the control chamber (10) and the command chamber (14) of the distributor in communication, is constantly connected to the high-pressure network, the movement of the piston (1) with respect to the distribution box (3) successively placing the control chamber (10) in communication with the lower chamber (10) connected to the high-pressure network and the duct (18) connected to the low-pressure network.

10. The percussive hydraulic apparatus as claimed in claim 4, characterized in that it comprises a lower chamber (10) formed between the lower end of the distribution box (3) and the piston (1), connected constantly to the low-pressure network by a duct (17), and a duct (18) which, opening radially into the bore (4) in which the piston (1) slides with respect to the distribution box (3), above the duct (16) placing the control chamber (10) and the command chamber (14) of the distributor in communication, is constantly connected to the high-pressure network, the movement of the piston (1) with respect to the distribution box (3).

* * * * *